US007887436B2

(12) United States Patent
Hirano

(10) Patent No.: US 7,887,436 B2
(45) Date of Patent: Feb. 15, 2011

(54) WOOD-TYPE GOLF CLUB HEAD

(75) Inventor: Tomoya Hirano, Kobe (JP)

(73) Assignee: SRI Sports Limited, Kobe (JP)

( * ) Notice: Subject to any disclaimer, the term of this patent is extended or adjusted under 35 U.S.C. 154(b) by 145 days.

(21) Appl. No.: 12/149,349

(22) Filed: Apr. 30, 2008

(65) Prior Publication Data

US 2009/0005190 A1 Jan. 1, 2009

(30) Foreign Application Priority Data

Jun. 29, 2007 (JP) ..... 2007-172773

(51) Int. Cl.
*A63B 53/04* (2006.01)

(52) U.S. Cl. ..... 473/345

(58) Field of Classification Search ..... 473/345, 473/324–350

See application file for complete search history.

(56) References Cited

U.S. PATENT DOCUMENTS 4,762,322 A * 8/1988 Molitor et al. ..... 473/345
5,935,020 A * 8/1999 Stites et al. ..... 473/345
6,340,337 B2 * 1/2002 Hasebe et al. ..... 473/349
6,344,002 B1 * 2/2002 Kajita ..... 473/330
6,354,962 B1 * 3/2002 Galloway et al. ..... 473/342
6,371,868 B1 * 4/2002 Galloway et al. ..... 473/324
6,607,452 B2 * 8/2003 Helmstetter et al. ..... 473/345
6,620,056 B2 * 9/2003 Galloway et al. ..... 473/342
6,679,786 B2 * 1/2004 McCabe ..... 473/305
6,716,114 B2 * 4/2004 Nishio ..... 473/314
6,800,040 B2 * 10/2004 Galloway et al. ..... 473/342
6,875,130 B2 * 4/2005 Nishio ..... 473/345
6,994,636 B2 * 2/2006 Hocknell et al. ..... 473/342
7,077,762 B2 * 7/2006 Kouno et al. ..... 473/314
7,137,905 B2 * 11/2006 Kohno ..... 473/314
7,147,572 B2 * 12/2006 Kohno ..... 473/314
7,153,221 B2 * 12/2006 Hocknell et al. ..... 473/342
7,160,205 B2 * 1/2007 Yamamoto ..... 473/345
7,163,468 B2 * 1/2007 Gibbs et al. ..... 473/329
7,211,005 B2 * 5/2007 Lindsay ..... 473/310
7,291,074 B2 * 11/2007 Kouno et al. ..... 473/314
7,300,360 B2 * 11/2007 Oyama ..... 473/314
7,632,196 B2 * 12/2009 Reed et al. ..... 473/345
2006/0009302 A1 1/2006 Oyama

FOREIGN PATENT DOCUMENTS

JP 08196665 A * 8/1996
JP 08308962 A * 11/1996
JP 11033145 A * 2/1999
JP 2000342721 A * 12/2000

(Continued)

*Primary Examiner*—Alvin A Hunter
(74) *Attorney, Agent, or Firm*—Birch, Stewart, Kolasch & Birch, LLP

(57) ABSTRACT

A wood-type golf club head has a hollow structure having a specific configuration in which, in order to make it easier to rotate the club head around the clubshaft during swing while maintaining a large lateral moment of inertia, the relative positions of the club face, the center of gravity, the clubshaft center line and the heel are optimized by limiting the face progression within a range between 21 to 27 mm, and the area ratio (S1/S2) of two specific right-angle triangles (OGP and ORQ) described on a horizontal plane (HP2) within a range of from 4 to 10.

10 Claims, 7 Drawing Sheets

FOREIGN PATENT DOCUMENTS

| | | | | |
|---|---|---|---|---|
| JP | 2001231888 | A | * | 8/2001 |
| JP | 2002102397 | A | * | 4/2002 |
| JP | 2003-70943 | A | | 3/2003 |
| JP | 2003070943 | A | * | 3/2003 |
| JP | 2003111874 | A | * | 4/2003 |
| JP | 2003230641 | A | * | 8/2003 |

* cited by examiner

WOOD-TYPE GOLF CLUB HEAD

BACKGROUND OF THE INVENTION

The present invention relates to a wood-type golf club head, more particularly to a hollow structure having a specific configuration capable of improving the directional stability of struck balls.

As well known in the art, if a golf club head hits a ball off the sweet spot towards the toe or heel, then the club head is rotated around the vertical axis passing through the center of gravity of the club head. Such a rotational motion gives the ball an unfavorable sidespin, and the ball deviates from the target trajectory.

Therefore, in order to decrease the rotational motion on off-center shots and thereby to improve the directional stability of the struck balls, there have been made efforts to increase the moment of inertia of the club head around the vertical axis passing through the center of gravity of the head (hereinafter, lateral moment of inertia). For that purpose, the weight of the club head is increased, the depth of the center of gravity of the head from the club face is increased, and/or the distance of the center of gravity from the clubshaft center line is increased.

However, if the club head weight is increased, the swing balance becomes heavy. If the distance of the center of gravity from the clubshaft center line is increased, the moment of inertia around the clubshaft center line is increased. In either case, the club head becomes hard to rotate and as a result, it is difficult to square the club face at impact. In other words, the club face can not return to the addressed square position at impact, and the balls tend to become slice shots. Such tendency is especially remarkable in the case of golfers who can not control club heads during swing very well such as beginners and intermediate golfers. Further, according to conventional designing, if the depth of the center of gravity is increased, the distance of the center of gravity is also increased, and the same problem arises.

SUMMARY OF THE INVENTION

It is therefore, an object of the present invention to provide a wood-type golf club head, in which, by specifically defining the configuration of the hollow structure of the head, it is easier for beginners and intermediate golfers to rotate the club head during swing so that the club face returns to the squared addressed position at impact, while maintaining a large lateral moment of inertia, therefore, the directional stability of struck balls is be improved.

According to the present invention, a wood-type hollow golf club head has a hollow structure comprising a face portion defining a club face for hitting a ball, and a hosel tubular portion provided with a shaft inserting hole defining a clubshaft center line, wherein in a cross section of the hollow structure taken along a vertical plane (VP2) including the center of gravity (G) of the club head and a sweet spot (SS) of the club face, a face progression is in a range of from 21 to 27 mm, and in a cross section of the hollow structure taken along a horizontal plane (HP2) including the center of gravity (G), a ratio (S1/S2) of the area S1 of a first right-angle triangle (OGP) to the area S2 of a second right-angle triangle (ORQ) is in a range of from 4 to 10, wherein the first right-angle triangle OGP is defined by three sides:

a side between the center of gravity (G) and an intersecting point (O) of the clubshaft center line with the horizontal plane (HP2);

a side extending from the center of gravity (G) in parallel with the back-and-forth direction of the club head; and a side extending from the intersecting point (O) in parallel with the heel-and-toe direction of the club head, and the second right-angle triangle ORQ is defined by three points:

the intersecting point (O);

an intersecting point (R) between a straight line drawn parallel with the heel-and-toe direction, passing through the intersecting point (O), and a straight line (Lh) drawn parallel with the back-and-forth direction and tangentially to the on-the-heel-side extreme end (H) of the club head; and an intersecting point (Q) between the straight line (Lh) and a straight line (Lf) drawn parallel with the heel-and-toe direction, passing through an intersecting point (F) between the club face and a straight line drawn parallel with the back-and-forth direction, passing through the center of gravity (G).

Therefore, the shaft center line is shifted towards the center of gravity, and accordingly, the distance therebetween can be decreased, without affecting the lateral moment of inertia and the depth of the center of gravity. In other words, a large lateral moment of inertia and a large depth of the center of gravity can be maintained. Accordingly, in spite of the large lateral moment of inertia, the club head is improved in the rotation during swing and it becomes easier to square the club face at impact, and as a result, the directional stability of struck balls can be improved.

In this application, the dimensions, positions and directions refer to those under the standard state of the club head unless otherwise noted.

Here, the standard state of the club head is such that, as shown in FIG. 2, the club head 1 is set on a horizontal plane HP1 so that the center line CL of the clubshaft (not shown) is inclined at the lie angle $\alpha$ while keeping the center line CL on a vertical plane VP1, and the club face 2 forms its loft angle $\beta$ with respect to the horizontal plane HP1, and the face angle is zero. Incidentally, in the case of the club head alone, the center line of the shaft inserting hole 7*a* can be used instead of the clubshaft center line CL because the center line of the shaft inserting hole 7*a* coincides with the center line of the clubshaft inserted.

The sweet spot SS is the point of intersection between the club face 2 and a straight line N1 drawn normally to the club face 2 from the center of gravity G of the head.

The back-and-forth direction is a direction parallel with the straight line N1 projected on the horizontal plane HP1.

The heel-and-toe direction is a direction parallel with the horizontal plane HP1 and perpendicular to the back-and-forth direction.

The face progression FP is a horizontal distance measured on the vertical plane VP2 including the center of gravity G and the sweet spot SS, from the vertical plane VP1 to the leading edge Le of the club head 1.

DESCRIPTION OF THE PREFERRED EMBODIMENTS

Figure 1:
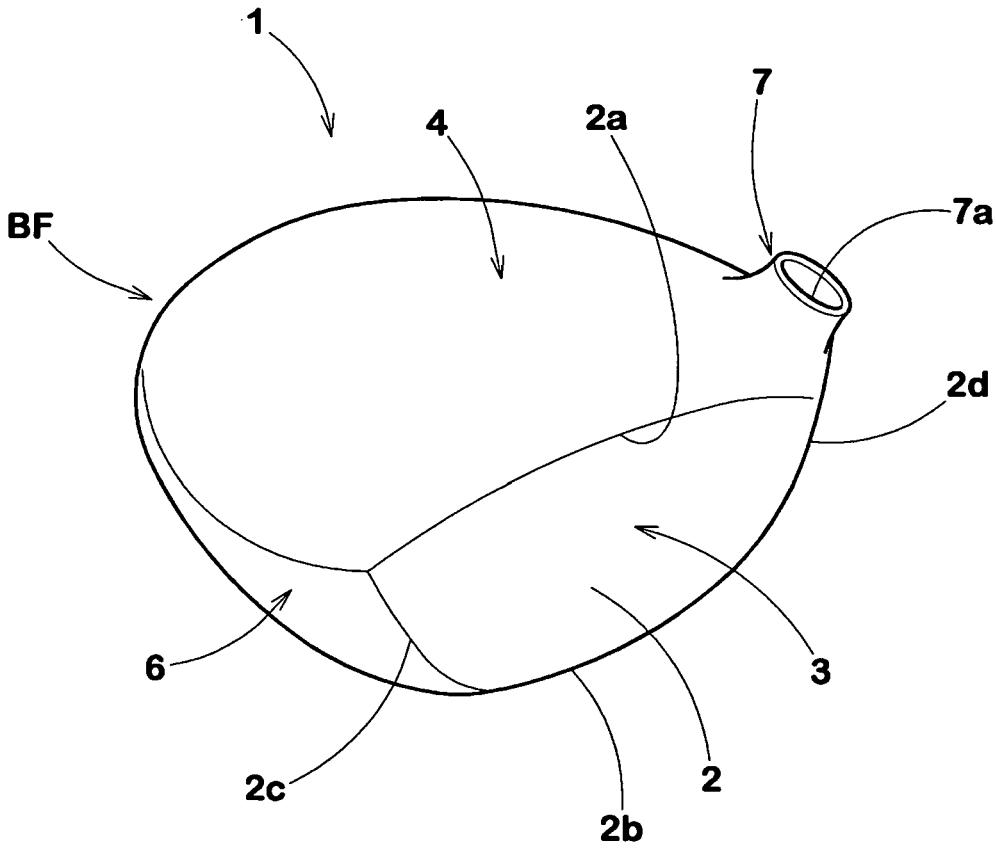
FIG. 1 is a perspective view of a wood-type golf club head according to the present invention.
Figure 2:
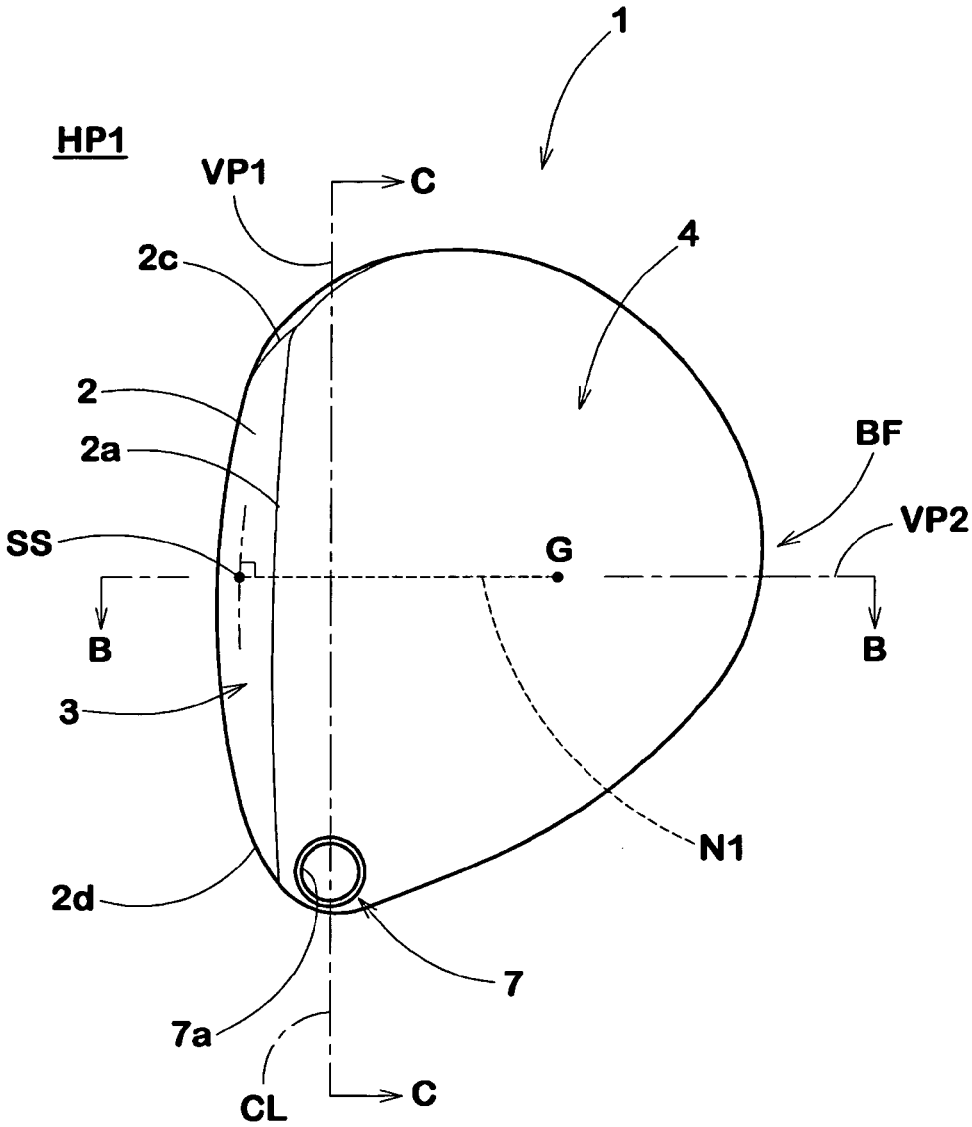
FIG. 2 is a top view thereof.
Figure 3:
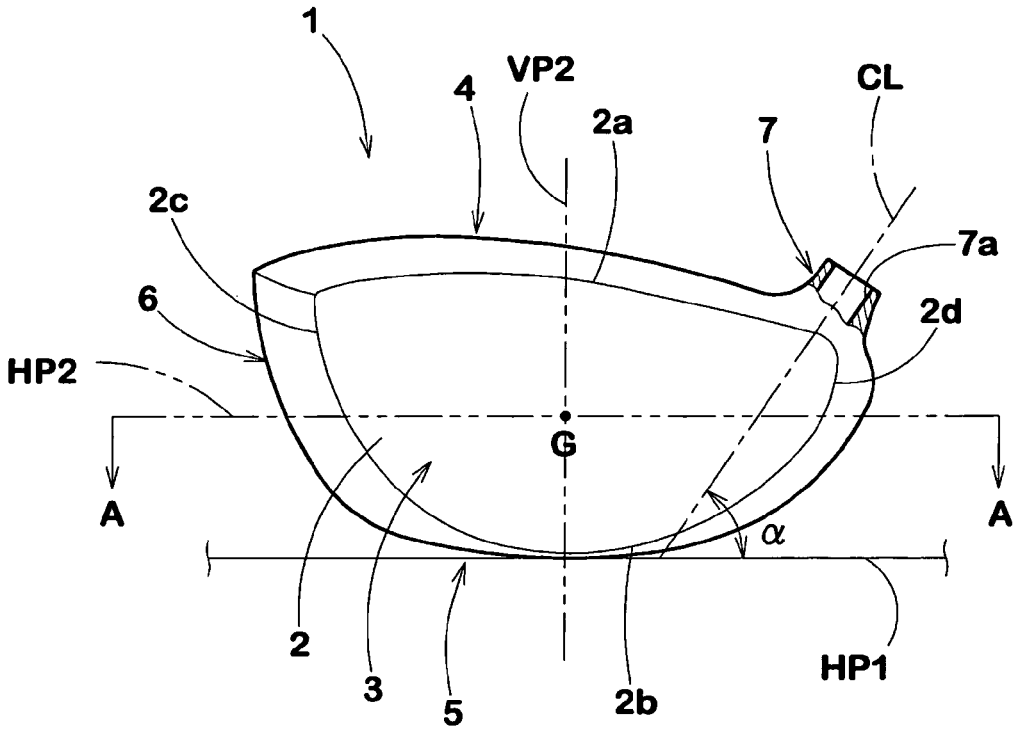
FIG. 3 is a front view thereof.
Figure 4:
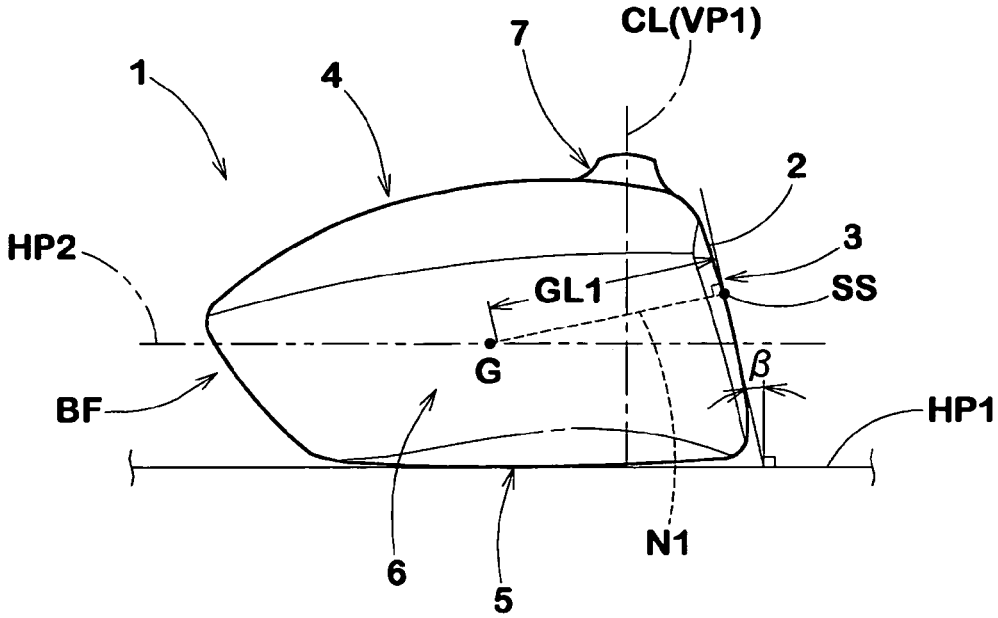
FIG. 4 is a side view thereof.

Embodiments of the present invention will now be described in detail in conjunction with accompanying drawings.

In the drawings, wood-type golf club head 1 according to the present invention comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*c* to a heel-side edge 2*d* of the club face 2 through the back face BF of the club head; and a hosel portion 7 at the heel side end of the crown to be attached to an end of a club shaft (not shown) inserted into the shaft inserting hole 7*a*. Thus, the club head 1 is provided with a hollow (i) and a shell structure with the thin wall. The hollow (i) in this example is a closed void space, but it may be filled with a foamed plastic, leaving a space from the backside of the face 3.

The club head 1 is essentially made of one or more metal materials. Of course, according to need, one or more kinds of plastics, fiber reinforced plastics and the like can be used in combination.

For the metal materials, for example, stainless steel alloys, maraging steels, pure titanium, titanium alloys, magnesium alloys, aluminum alloys and the like.

For the titanium alloys, for example, Ti-6Al-4V, Ti-15V-3Cr-3Al-3Sn, Ti-15Mo-5Zr-3Al, Ti-13V-11Cr-3Al and the like can be used.

The club head 1 is formed by assembling two or more (usually, 2 to 5) components made from the above-mentioned metal materials through suitable processes such as casting, forging, and press molding.

If the total mass of the club head 1 becomes less than 180 grams, then it becomes difficult to provide a necessary strength for the club head, and the lateral moment of inertia tends to become insufficient. Further, the kinetic energy of the club head used to hit a ball is decreased. This has a disadvantage for the improvement in the carry distance. On the other hand, if the total mass of the club head 1 becomes too large, it becomes difficult to square the club face at impact, and the carry distance and directionality are deteriorated. Therefore, the total mass of the club head 1 is preferably set in a range of not less than 180 grams, more preferably not less than 185 grams, still more preferably not less than 190 grams, but not more than 210 grams, more preferably not more than 205 grams.

A large head volume can give the golfer a feeling of easy when addressing the ball and can increase the lateral moment of inertia and the depth of the center of gravity of the club head to improve the directionality of the hit ball. However, an excessively large volume has problems with the swing balance, durability, weight redaction, and compliance with golf rules.

Therefore, the volume of the club head 1 is preferably set in a range of not less than 400 cc, more preferably not less than 425 cc, still more preferably not less than 450 cc, but not more than 470 cc, more preferably not more than 460 cc.

In order to improve the directionality of the hit balls on off-center shots, the lateral moment of inertia of the club head 1 around the vertical axis passing through the center of gravity G of the club head is preferably not less than 4500 g sq. cm, more preferably not less than 5000 g sq. cm, still more preferably not less than 5500 g sq. cm. But, in order to comply with golf rules, the lateral moment of inertia is preferably not more than 5900 g sq. cm.

Figure 5:
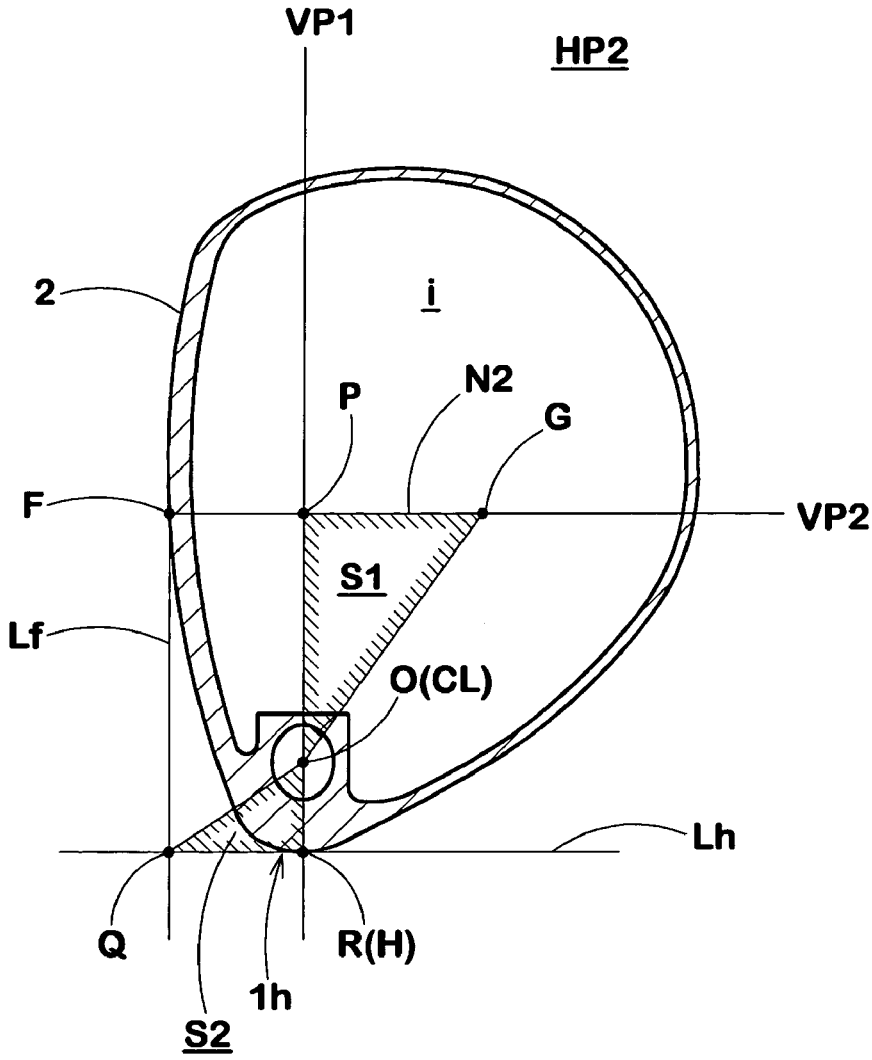
FIG. 5 is a cross sectional view taken along line A-A in FIG. 3.

According to the present invention, as shown in FIG. 5, with respect to the sectional shape of the head taken along a second horizontal plane HP2, the area S1 sq. mm of a first triangle OGP and the area S2 sq. mm of a second triangle ORQ are limited such that the ratio (S1/S2) is in a range of 4 to 10. The second horizontal plane HP2 is a horizontal plane including the center of gravity G of the club head.

The first triangle OGP is a right-angle triangle whose three vertices are: the center of gravity G; an intersecting point O of the clubshaft center line CL with the second horizontal plane HP2; and an intersecting point P of three planes which are the second horizontal plane HP2, the above-mentioned vertical plane VP1 including the clubshaft center line CL, and a vertical plane VP2 including the center of gravity G and the sweet spot Ss. The second triangle ORQ is a right-angle triangle whose three vertices are: the above-mentioned intersecting point O and the following two points Q and R.

On the second horizontal plane HP2 (or in the cross section of FIG. 5): the point R is the intersecting point of the vertical plane VP1 and a (heel end) straight line Lh which is drawn in parallel with the back-and-forth direction and tangential to the extreme end H of the club head on the heel-side; and the point Q is the intersecting point of the above-mentioned (heel end) straight line Lh and a (face side) straight line Lf which is drawn in parallel with the heel-and-toe direction, passing through the intersecting point F of the vertical plane VP2 with the club face 2.

The area S1 of the first triangle OGP is largely affected by the relative position of the center of gravity G to the intersecting point O.

If the point O shifts toward the toe, which results in a decrease in the area S1 and a decrease in the length of the side between the points O and G, then the distance GL2 of the center of gravity G is decreased, and as a result, it becomes easy to square the club face at impact. If the center of gravity G shifts toward the toe and/or back face, which results in an increase in the area S1 and an increase in the length of the side between the points O and G, then the distance GL2 of the center of gravity is increased, and it becomes difficult to square the club face at impact. Therefore, there is a tendency that, along with the increase in the area S1, it becomes difficult to hold the ball at one position on the club face in a moment of striking the ball.

On the other hand, if the point O shifts toward the toe and/or back face, which results in an increase in the area S2 of the second triangle ORQ, then the length of the side between the points O and G is decreased. Therefore, there is a tendency that, along with the increase in the area S2, it becomes easier to square the club face at impact.

Thus, focusing attention on the area S1 of the first triangle OGP and the area S2 of the second triangle ORQ, the present inventor investigated the relationship between the areas S1 and S2 and the easiness of making the club face square at impact, and it was found that, by specifically limiting the area ratio (S1/S2), the distance GL2 of the center of gravity can be decreased, and the rotation of the club head around the clubshaft center line CL during swing towards the squared position can be improved, without decreasing the increased large lateral moment of inertia of the head.

If the ratio (S1/S2) is more than 10, then the distance GL2 of the center of gravity can not be effectively decreased, and the rotation the club head can not be effectively improved. In this light, it is preferable that the ratio (S1/S2) is not more than 9, more preferably not more than 8.

On the on other hand, if the ratio (S1/S2) is less than 4, then the distance GL2 of the center of gravity is decreased too much, and the club head rotates too much which results in hook shot. In this light, the ratio (S1/S2) is preferably not less than 5, more preferably not less than 6.

Further, if the area S1 of the first triangle OGP is too small, then there is a possibility that the lateral moment of inertia of the club head 1 becomes insufficient.

Therefore, the area S1 is preferably not less than 350 sq. mm, more preferably not less than 400 sq. mm, still more preferably not less than 410 sq. mm, especially preferably not less than 470 sq. mm. By limiting the ratio (S1/S2) as above, the rotation of the club head can be improved, and it becomes possible to increase the area S1 over 350 sq. mm. On the other hand, there is a possibility that the rotation becomes worse with the increase in the area S1, therefore, the area S1 of the first triangle OGP is preferably not more than 700 sq. mm, more preferably not more than 600 sq. mm, still more preferably not more than 550 sq. mm.

The length of the side PG (side between P and G) of the first triangle OGP indicates how the center of gravity G is spaced apart from the clubshaft center line CL towards the back side of the club head.

If the length of the side PG is decreased, a rotation of the club head at the time of off-center shots increases. Therefore, it is preferable that the length of the side PG is not less than 20 mm, more preferably not less than 23 mm, still more preferably not less than 25 mm. On the other hand, if the length of the side PG is increased, then the club head 1 is hard to rotate to return to the squared position at impact, and it is difficult for the golfer to square the club face. Therefore, the length of the side PG is preferably not more than 40 mm, more preferably not more than 35 mm, still more preferably not more than 29 mm.

The length of the side PO (side between P and O) of the first triangle OGP indicates how the center of gravity G is spaced apart from the clubshaft center line CL towards the toe. If the length of the side PO is too short, then the head speed decreases, and the club head 1 easily rotates over the squared position at impact. Therefore, the length of the side PO is preferably not less than 30 mm, more preferably not less than 33 mm, still more preferably not less than 35 mm. On the other hand, if the length of the side PO is too long, it is difficult for the golfer to return the club face to the squared position at impact. Therefore, it preferable that the length of the side PO is not more than 45 mm, more preferably not more than 40 mm, still more preferably not more than 37 mm.

If the area S2 of the second triangle ORQ is too small, then there is a possibility that the retuning of the club head during swing becomes insufficient. Therefore, the area S2 of the second triangle ORQ is preferably not less than 30 sq. mm, more preferably not less than 50 sq. mm, still more preferably not less than 59 sq. mm. However, if the area S2 is too large, then there is a possibility that the retuning is excessive and the hit ball results in hook. Therefore, the area S2 is preferably not more than 150 sq. mm, more preferably not more than 130 sq. mm, still more preferably not more than 110 sq. mm.

The length of the side OR (side between O and R) of the second triangle ORQ indicates how the clubshaft center line CL is spaced apart from the heel 1*h* towards the toe.

If the length of the side OR is decreased, the club head 1 becomes hard to return to the squared position during swing, and it becomes difficult for the golfer to control the rotation of the club head around the clubshaft center line CL. Therefore, the length of the side OR is preferably not less than 5 mm, more preferably not less than 7 mm, still more preferably not less than 9 mm. However, if the length of the side OR is too long, there is a possibility that the head speed is decreased and the club head easily rotates over the square position. Therefore, it is preferable that the length of the side OR is not more than 20 mm, more preferably not more than 15 mm, still more preferably not more than 13 mm.

The length of the side QR (side between Q and R) of the second triangle ORQ indicates how the clubshaft center line CL is spaced apart from the club face towards the backside.

Figure 7:
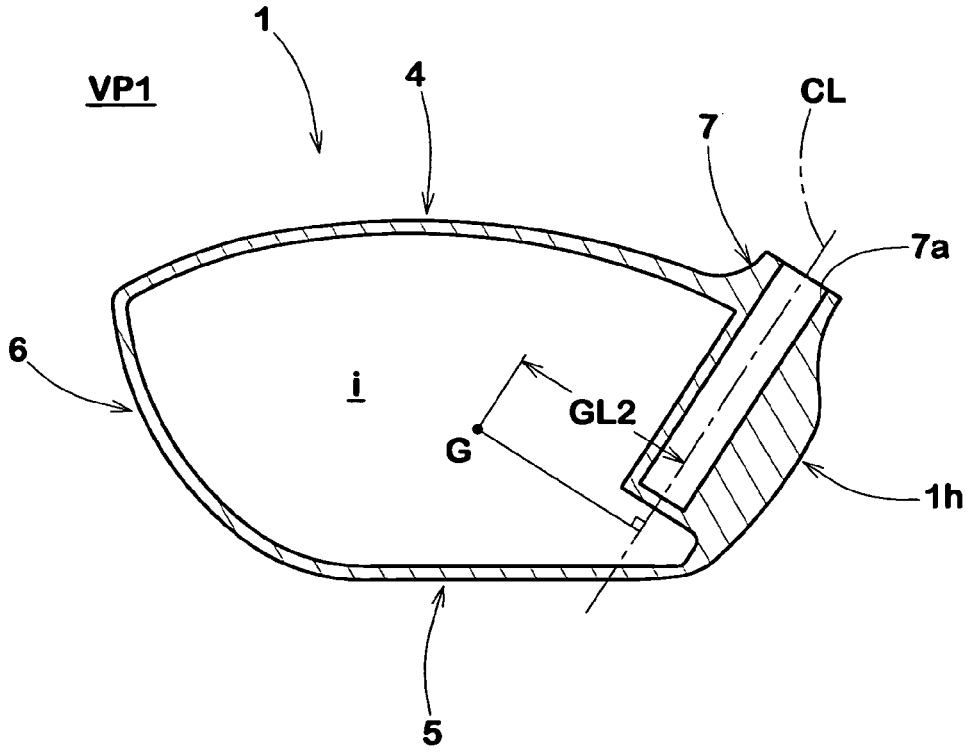
FIG. 7 is a cross sectional view taken along line C-C in FIG. 2.

If the length of the side QR is decreased, the retuning of the club head during swing becomes insufficient, and it becomes difficult for the golfer to control the rotation of the club head around the clubshaft center line CL. Therefore, the length of the side QR is preferably not less than 8 mm, more preferably not less than 10 mm, still more preferably not less than 13 mm. If the length of the side QR is too long, there is a possibility that the head speed is decreased and the club head easily rotates over the square position. Therefore, the length of the side QR is preferably not more than 25 mm, more preferably not more than 20 mm, still more preferably not more than 17 mm. Besides, to comply golf rules, the heel 1*h* of the club head 1 is positioned at a distance less than 15.88 mm from the clubshaft center line CL as shown in FIG. 7.

Figure 6:
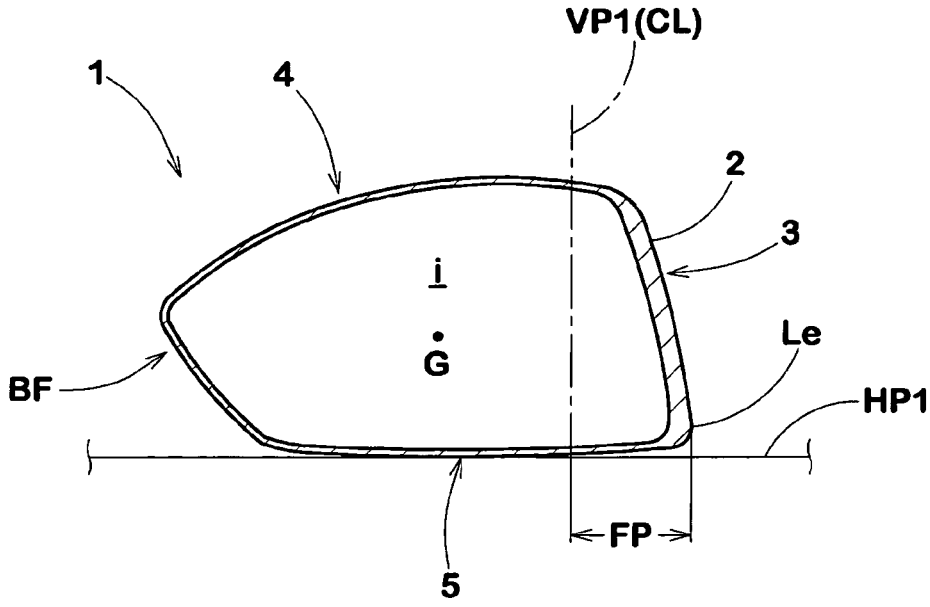
FIG. 6 is a cross sectional view taken along line B-B in FIG. 2.

According to the present invention, as shown in FIG. 6, the face progression FP is set in a range of from 21 to 27 mm.

Figure 8A:
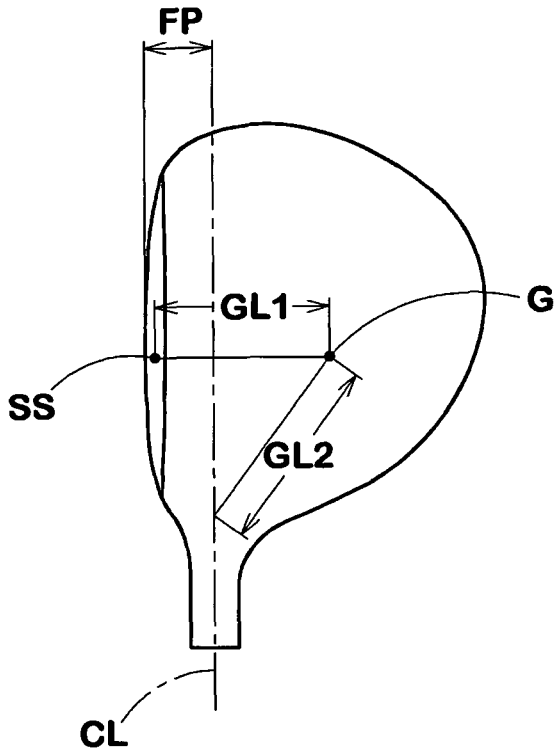
FIGS. 8(*a*) and 8(*b*) are top views of club heads for explaining the effect of the increase in the face progression.
Figure 8B:
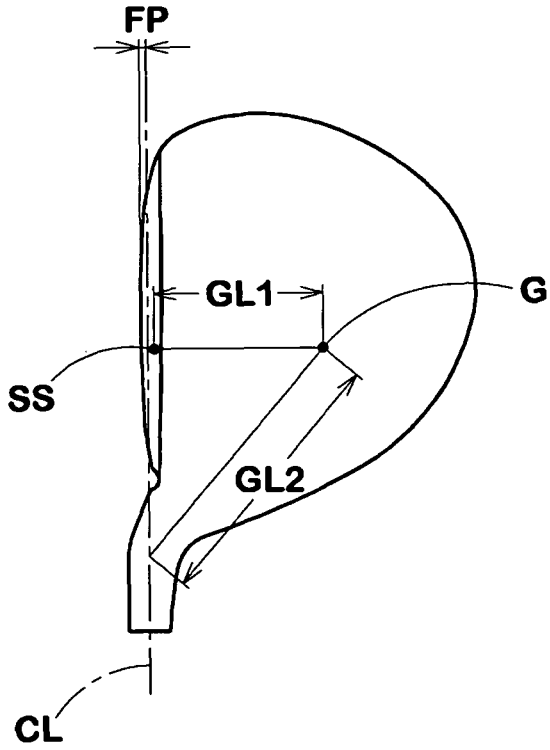

FIG. 8(*a*) and FIG. 8(*b*) show a club head having a larger face progression FP and a club head having a smaller face progression FP. By increasing the face progression FP, the position of the clubshaft center line CL is shifted backwards of the club head. Thereby, without decreasing the lateral moment of inertia and the depth GL1 of the center of gravity, the clubshaft center line CL can get closer to the center of gravity G of the club head to decrease the distance GL2 of the center of gravity, and the ratio (S1/S2) can be set in the above-mentioned ranges.

In a club head having a large lateral moment of inertia around the vertical axis, by increasing the face progression FP, the distance GL2 of the center of gravity is decreased. As a result, the moment of inertia around the shaft center line is decreased, and it becomes easy for the golfers to control the club head during swing. Thus, even for beginners and intermediate golfers, it is possible to avoid slice shots.

Therefore, the face progression FP is set in a range of not less than 21 mm, preferably not less than 22 mm, more preferably not less than 23 mm. However, if the face progression FP is excessively increased, then the user tends to feel odd about the top view, and the distance GL2 of the center of gravity becomes very short, and as a result, the ball is liable to become hook. In this light, the face progression FP is preferably not more than 27 mm, more preferably not more than 25 mm.

Comparison Tests

Based on the specifications shown in Table 1, wood-type hollow golf club heads (volume: 450 cc, mass: 200 g, lie angle: 58 degrees, loft angle: 11 degrees) were prepared and tested for the directionality of the hit balls.

Figure 9:
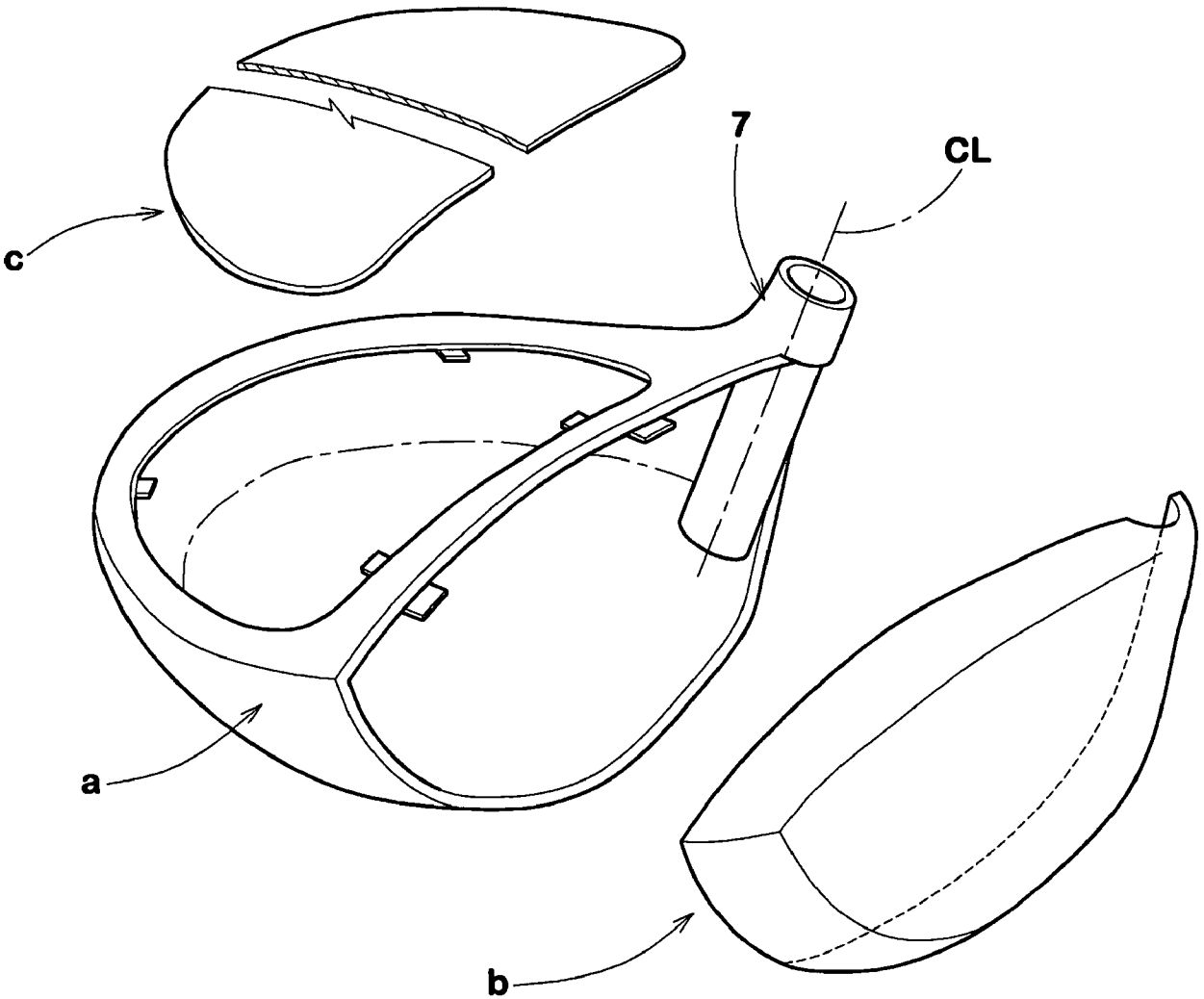
FIG. 9 is an exploded perspective view showing a three-piece structure used in the wood-type golf club head according to the present invention.

AS shown in FIG. 9, each of the club heads was composed of a main body (a), a face plate (b) and a crown plate (c). The main body was formed by casting Ti-6Al-4V, including the hosel portion 7, and provided with a front opening and a top opening. The face plate (b) was formed by press molding a rolled sheet of Ti-5.5Al-1Fe and provided with a turnback around the club face. The crown plate (c) was formed by forging Ti-15V-3Cr-3Sn. The main body (a), face plate (b) and crown plate (c) were assembled and Tig welded together into a hollow structure. The ratio (S1/S2) and face progression FP were changed by changing the position of the hosel portion 7 on the head main body (a).

In the directionality test, each of the club heads was attached to a FRP shaft (SRI sports Limited "MP400", flex R, mass 48 grams) and a wood club (#1) was prepared.

Using each of the wood clubs, five golfers having handicap ranging from 10 to 20 hit three-piece balls (SRI sports Limited "XXIO") ten-times per person.

The difference of the stop position of the struck ball from the target trajectory of the ball was measured.

The results are show in Table 1, wherein "Average" means that of the fifty shots (ten times×five persons). "Minimum" means the mean value of the minimum differences of the five persons. "Maximum" means the mean value of the maximum differences of the five persons. "+" sign means "slice", and "−" sign means "hook".

From the test results, it was confirmed that the absolute value of the maximum difference having "plus" sign (slice) can be decreased. Thus, slice shot can be lessened. Further, the difference (Maximum-Minimum) is decreased, Therefore, the directional stability of struck balls can be significantly improved.

TABLE 1

| Head | Ref. 1 | Ref. 2 | Ref. 3 | Ex. 1 | Ex. 2 | Ex. 3 | Ex. 4 | Ref. 4 | Ref. 5 | Ref. 6 |
|---|---|---|---|---|---|---|---|---|---|---|
| Face progression FP (mm) | 20 | 20 | 21 | 21 | 22 | 23 | 25 | 25 | 27 | 27 |
| Length between P and O (mm) | 38 | 36 | 39 | 37 | 36 | 35 | 33 | 31 | 35 | 31 |
| Length between P and G (mm) | 30 | 30 | 29 | 29 | 28 | 27 | 25 | 25 | 23 | 23 |
| PO/PG | 1.3 | 1.2 | 1.3 | 1.3 | 1.3 | 1.3 | 1.3 | 1.2 | 1.5 | 1.3 |
| Area S1 of First triangle OPG (sq · mm) | 570 | 540 | 566 | 537 | 504 | 473 | 413 | 388 | 403 | 357 |
| Length between Q and R (mm) | 12 | 12 | 13 | 13 | 14 | 15 | 17 | 17 | 19 | 19 |
| Length between O and R (mm) | 8 | 10 | 7 | 9 | 10 | 11 | 13 | 15 | 11 | 17 |
| Area S2 of Second triangle ORQ (sq · mm) | 48 | 60 | 46 | 59 | 70 | 83 | 111 | 128 | 105 | 162 |
| S1/S2 *1 | 12 | 9 | 12 | 9 | 7 | 6 | 4 | 3 | 4 | 2 |
| Lateral moment of inertia (g sq · cm) | 5700 | 5700 | 5700 | 5700 | 5700 | 5700 | 5700 | 5700 | 5700 | 5700 |
| Difference from target trajectory | | | | | | | | | | |
| Average (m) | +16.0 | +9.0 | +10.0 | +4.0 | 0.0 | −3.0 | −4.0 | −7.0 | −6.0 | −12.0 |
| Maximum (m) | +32.0 | +19.0 | +23.0 | +14.0 | +11.0 | +8.0 | +7.0 | +1.0 | +4.0 | −2.0 |
| Minimum (m) | +2.0 | −4.0 | −3.0 | −9.0 | −10.0 | −12.0 | −14.0 | −20.0 | −17.0 | −22.0 |
| Maximum − Minimum (m) | +30.0 | +23.0 | +26.0 | +23.0 | +21.0 | +20.0 | +21.0 | +21.0 | +21.0 | +20.0 |

*1 corrected to an integer by rounding the digit in the first decimal place

The invention claimed is:

1. A wood-type hollow golf club head with a hollow structure comprising: a face portion defining a club face for hitting a ball; and a hosel tubular portion provided with a shaft inserting hole defining a clubshaft center line, wherein in a cross section of the hollow structure taken along a vertical plane (VP2) including the center of gravity (G) of the club head and a sweet spot (SS) of the club face, a face progression is in a range of from 21 to 27 mm, and in a cross section of the hollow structure taken along a horizontal plane (HP2) including the center of gravity (G), a ratio (S1/S2) of the area (S1) of a first right-angle triangle (OGP) to the area (S2) of a second right-angle triangle (ORQ) is in a range of from 4 to 10, wherein the first right-angle triangle (OGP)is defined by three sides:

a side between the center of gravity (G) and an intersecting point (O) of the clubshaft center line with the horizontal plane (HP2);

a side PG extending from the center of gravity (G) in parallel with the back-and-forth direction of the club head; and a side PO extending from the intersecting point (O) in parallel with the heel-and-toe direction of the club head, and the second right-angle triangle (ORQ)is defined by three points:

the intersecting point (O);

an intersecting point (R) between a straight line drawn parallel with the heel-and-toe direction, passing through the intersecting point (O), and a straight line (Lh) drawn parallel with the back-and-forth direction and tangentially to the on-the-heel-side extreme end (H) of the club head; and an intersecting point (Q) between the straight line (Lh) and a straight line (Lf) drawn parallel with the heel-and-toe direction, passing through an intersecting point (F) between the club face and a straight line drawn parallel with the back-and-forth direction, passing through the center of gravity (G), wherein the area S1 of the first right-angle triangle (OGP) is not less than 350 sq.mm and not more than 700 sq.mm.

2. The wood-type golf club head according to claim 1, wherein a lateral moment of inertia of the head around a vertical axis passing through the center of gravity (G) is not less than 4500 g sq.cm.

3. The wood-type golf club head according to claim 1, wherein the ratio (S1/S2) is 5.5 to 9.5.

4. The wood-type golf club head according to claim 1, wherein the volume of the head is not less than 400 cc.

5. The wood-type golf club head according to claim 1, wherein the mass of the head is not more than 210 grams.

6. The wood-type golf club head according to claim 1, wherein the area (S2) of the second triangle (ORQ) is not less than 30 sq.mm and not more than 150 sq.mm.

7. The wood-type golf club head according to claim 1, wherein the length of the side (OR) of the second triangle (ORQ) between the intersecting point (O) and intersecting point (R) is not less than 5 mm and not more than 20 mm.

8. The wood-type golf club head according to claim 1, wherein the length of the side (QR) of the second triangle (ORQ) between the intersecting point (Q) and intersecting point (R) is not less than 8 mm and not more than 25 mm.

9. A wood-type golf club head with a hollow structure comprising: a face portion defining a club face for hitting a ball; and a hosel tubular portion provided with a shaft inserting hole defining a clubshaft center line, wherein in a cross section of the hollow structure taken along a vertical plane (VP2) including the center of gravity (G) of the club head and a sweet spot (SS) of the club face, a face progression is in a range of from 21 to 27 mm, and in a cross section of the hollow structure taken along a horizontal plane (HP2) including the center of gravity (G), a ratio (S1/S2) of the area (S1) of a first right-angle triangle (OGP) to the area (S2) of a second right-angle triangle (ORQ) is in a range of from 4 to 10, wherein the first right-angle triangle (OGP) is defined by three sides:

a side between the center of gravity (G) and an intersecting point (O) of the clubshaft center line with the horizontal plane (HP2);

a side (PG) extending from the center of gravity (G) in parallel with the back-and-forth direction of the club head; and a side (PO) extending from the intersecting point (O) in parallel with the heel-and-toe direction of the club head, and the second right-angle triangle (ORQ) is defined by three points:

the intersecting point (O);

an intersecting point (R) between a straight line drawn parallel with the heel-and-toe direction, passing through an intersecting point (O), and a straight line (Lh) drawn parallel with the back-and-forth direction and tangentially to the on-the-heel-side extreme end (H) of the club head; and an intersecting point (Q) between the straight line (Lh) and a straight line (Lf) drawn parallel with the heel-and-toe direction, passing through an intersecting point (F) between the club face and a straight line drawn parallel with the back-and-forth direction, passing through the center of gravity (G), and wherein the length of the side (PG) of the first triangle OGP) is not less than 20 mm and not more than 40 mm.

10. A wood-type golf club head with a hollow structure comprising: a face portion defining a club face for hitting a ball; and a hosel tubular portion provided with a shaft inserting hole defining a clubshaft center line, wherein in a cross section of the hollow structure taken along a vertical plane (VP2) including the center of gravity (G) of the club head and a sweet spot (SS) of the club face, a face progression is in a range of from 21 to 27 mm, and in a cross section of the hollow structure taken along a horizontal plane (HP2) including the center of gravity (G), a ratio (S1/S2) of the area S1 of a first right-angle triangle (OGP) to the area S2 of a second right-angle triangle (ORQ) is in a range of from 4 to 10, wherein the first right-angle triangle (OGP) is defined by three sides:

a side between the center of gravity (G) and an intersecting point (O) of the clubshaft center line with the horizontal plane (HP2);

a side (PG) extending from the center of gravity(G)in parallel with the back-and-forth direction of the club head; and a side (PO) extending from the intersecting point (O) in parallel with the heel-and-toe direction of the club head, and the second right-angle triangle (ORQ) is defined by three points:

the intersecting point (O);

an intersecting point (R) between a straight line drawn parallel with the heel-and-toe direction, passing through the intersecting point (O), and a straight line (Lh) drawn parallel with the back-and-forth direction and tangentially to the on-the-heel-side extreme end (H) of the club head; and an intersecting point (Q) between the straight line (Lh) and a straight line (Lf) drawn parallel with the heel-and-toe direction, passing through an intersecting point (F) between the club face and a straight line drawn parallel with the back-and-forth direction, passing through the center of gravity (G), and wherein the length of the side (PO) of the first triangle (OGP) is not less than 30 mm and not more than 45 mm.

* * * * *